US009644392B2

(12) United States Patent
Landry

(10) Patent No.: US 9,644,392 B2
(45) **Date of Patent: *May 9, 2017**

(54) BARRIER CABLE ANCHOR RAIL

(71) Applicant: Actuant Corporation, Menomonee Falls, WI (US)

(72) Inventor: Stanley A. Landry, Euless, TX (US)

(73) Assignee: Actuant Corporation, Menomonee Falls, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/918,289

(22) Filed: Oct. 20, 2015

(65) Prior Publication Data

US 2016/0040449 A1 Feb. 11, 2016

Related U.S. Application Data

(63) Continuation of application No. 13/645,078, filed on Oct. 4, 2012, now Pat. No. 9,194,155.

(60) Provisional application No. 61/544,872, filed on Oct. 7, 2011.

(51) Int. Cl.

| | |
|---|---|
| ***E04H 17/10*** | (2006.01) |
| ***E01F 13/02*** | (2006.01) |
| ***E04G 21/32*** | (2006.01) |
| ***E04H 17/06*** | (2006.01) |
| ***E04H 17/08*** | (2006.01) |
| ***E04H 17/24*** | (2006.01) |
| *E04F 11/18* | (2006.01) |

(52) U.S. Cl.

CPC ..... *E04H 17/10* (2013.01); *E01F 13/028* (2013.01); *E04G 21/3219* (2013.01); *E04H 17/06* (2013.01); *E04H 17/08* (2013.01); *E04H 17/24* (2013.01); *E04F 11/1859* (2013.01); *E04F 2011/1893* (2013.01)

(58) Field of Classification Search

CPC E04F 15/00; E04F 15/06; E04F 13/00; F16G 11/00; E04H 17/08; E04H 17/10; E04B 1/21; E04C 5/12

See application file for complete search history.

(56) References Cited

U.S. PATENT DOCUMENTS

| | | | |
|---|---|---|---|
| 1,107,406 | A | 8/1914 | Burns |
| RE22,060 | E | 4/1942 | Hayden et al. |
| 3,091,897 | A | 6/1963 | Hillberg |
| 3,293,811 | A | 12/1966 | Rice |
| 3,408,783 | A | 11/1968 | Rice |

(Continued)

*Primary Examiner* — Daniel Wiley

(74) *Attorney, Agent, or Firm* — Michael Best & Friedrich LLP

(57) ABSTRACT

A barrier cable anchor rail assembly is disclosed. The assembly is adapted to be encapsulated in a concrete column and engage a plurality of cables to provide a barrier between successive columns of concrete. The assembly includes a first rail member and a plurality of threaded connectors. The threaded connectors are adapted to be engaged by a chuck that includes cable grippers adapted to engage one of the cables. The threaded connectors can be attached to the first rail member in the same orientation with a predetermined spacing between the central axis of the plurality of threaded connectors. The first rail member maintains the orientation and predetermined spacing of the threaded connectors and provides support to the concrete column in which it is encapsulated. A barrier cable assembly adapted to form a barrier between a first concrete column and a second concrete column is also disclosed.

21 Claims, 4 Drawing Sheets

(56) References Cited

U.S. PATENT DOCUMENTS

| | | | |
|---|---|---|---|
| 3,820,832 | A | 6/1974 | Brandestini et al. |
| 3,937,607 | A | 2/1976 | Rodormer |
| 4,781,006 | A | 11/1988 | Haynes |
| 4,959,940 | A | 10/1990 | Witschi |
| 5,308,184 | A | 5/1994 | Bernard |
| 5,758,742 | A | 6/1998 | Chiou et al. |
| 6,578,342 | B2 | 6/2003 | Faynor |
| 8,051,615 | B2 | 11/2011 | Mathews et al. |
| 2006/0201083 | A1 | 9/2006 | Hayes et al. |
| 2009/0139177 | A1 | 6/2009 | Holdsworth et al. |
| 2012/0297728 | A1 | 11/2012 | Viereck et al. |

BARRIER CABLE ANCHOR RAIL

CROSS-REFERENCE TO RELATED APPLICATIONS

This application is a continuation of U.S. patent application Ser. No. 13/645,078, filed Oct. 4, 2012, which claims the benefit of U.S. Provisional Patent Application Ser. No. 61/544,872 filed Oct. 7, 2011. The entire contents of each of these documents are hereby incorporated by reference for all purposes.

STATEMENT OF FEDERALLY SPONSORED RESEARCH OR DEVELOPMENT

Not applicable.

FIELD OF THE INVENTION

The present invention relates to cable barriers in a concrete structure. More specifically, the present invention relates to a barrier cable anchor rail used in creating a cable barrier between columns of concrete in a concrete structure.

BACKGROUND

A series of parallel cables spanning between adjacent sections, or columns, of concrete are used to form barriers in concrete structures. These cables may serve as a barrier against pedestrians, vehicles, and construction workers that are using or working in the concrete structure.

Prior art structures have been developed to form these cable barriers. For example, the prior art includes a multiple bracket assembly that was attached to the exterior of the concrete structure to provide a structure that the cables could span between. However, forming such barrier bracket assemblies involved providing individual sleeves in the concrete to allow for anchor rods to pass through to later install brackets for the cable barrier assembly. This provided the possibility that the sleeves would not be correctly installed in relation to one another and may need to be recast to properly install the cable barrier. In addition, such bracket assemblies included additional mounting structures that needed to be attached to the exterior of the concrete providing exposure to the elements, which may lead to corrosion and a shortened life of the bracket assembly.

Other prior art anchor systems involved embedding individual inserts into the concrete structure that engage a threaded post and anchor chuck that grips an individual cable. This process of installing individual inserts is tedious and can be completed on-site by drilling individual holes into the face of the concrete for the inserts. Alternatively, the inserts may be individually cast directly into the concrete. In either case, the process of individually installing the inserts into the concrete structure increases the likelihood that one or more of the inserts is not installed in the proper orientation or that the proper spacing between successive inserts is not maintained.

Thus, the present invention seeks to provide a cable barrier assembly that seeks to overcome these problems.

SUMMARY OF THE INVENTION

In one embodiment, the present invention provides for a barrier cable anchor rail assembly adapted to be encapsulated in a column of concrete and engage a plurality of cables to provide a barrier between the column of concrete and a successive column of concrete in a structure. The barrier cable anchor rail assembly includes an elongated first rail member of a certain length and a plurality of threaded connectors. Each threaded connector is threaded internally or externally, has a central axis, a proximal end, and a distal end, and is adapted to be engaged by a chuck that includes cable grippers for engaging one of the plurality of cables. The plurality of threaded connectors are attached to the first rail member in the same orientation and along the length of the first rail member, such that a predetermined spacing exists between the central axis of the plurality of threaded connectors and the threads of the connectors are exposed to the outside of the column of concrete in which the barrier cable anchor rail assembly is encapsulated. The first rail member maintains the predetermined spacing and orientation of the plurality of threaded connectors and provides structural support to the column of concrete in which the barrier cable anchor rail assembly is encapsulated.

In another form, the present invention provides for a barrier cable assembly adapted to form a barrier between a first concrete column and a second concrete column. The cable barrier assembly includes a plurality of cables and a first cable anchor rail assembly. The first cable anchor rail assembly includes an elongated first rail member of a certain length and that is adapted to provide support to a surrounding structure in which the first rail member is encapsulated and a plurality of threaded connectors. Each threaded connector can be internally or externally threaded and have a central axis, a proximal end, and a distal end. The plurality of threaded connectors are attached to the first rail member along the length of the first rail member and such that a predetermined spacing exists between the central axis of each successive threaded connector. The cable barrier assembly also includes a first plurality of chucks that include cable grippers adapted to engage one of the plurality of cables, each of the first plurality of chucks engaging one of the plurality of threaded connectors of the first cable anchor rail assembly. The first cable anchor rail assembly is encapsulated in and provides support to the first concrete column, the threads of the plurality of threaded connectors associated with the first cable anchor rail assembly being exposed to the outside of the first concrete column. The plurality of cables extend between the first plurality of chucks engaging the plurality of threaded connectors of the first cable anchor rail assembly in the first concrete column and the second concrete column.

In yet another form, the present invention provides for a barrier cable anchor rail assembly adapted to be encapsulated in a column of concrete and engage a plurality of cables to provide a barrier between the column of concrete and a successive column of concrete in a structure. The barrier cable anchor rail assembly includes an elongated first rail member of a first length and that is adapted to provide support to the column of concrete. The assembly can also include an elongated second rail member of a second length and that is adapted to provide support to the column of concrete. Furthermore, the assembly includes a plurality of threaded connectors, each threaded connector being internally or externally threaded and having a central axis, a proximal end, and a distal end. Each threaded connector is adapted to be engaged by a chuck that includes cable grippers that are adapted to engage one of the plurality of cables. The assembly can also include a support bar for supporting the plurality of threaded connectors. The plurality of threaded connectors are attached to the first rail member and the second rail member at the distal end of each threaded connector, along the first length of the first rail member and along the second length of the second rail member, in the same orientation, and with a predetermined spacing between the central axis of the plurality of threaded connectors. The support bar is attached to each of the plurality of threaded connectors at the proximal end of each threaded connector. The threads of the connectors are exposed to the outside of the column of concrete in which the barrier cable anchor rail assembly is encapsulated. The first rail member and the second rail member maintain the predetermined spacing and orientation.

DETAILED DESCRIPTION OF THE PREFERRED EMBODIMENT

Figure 1:
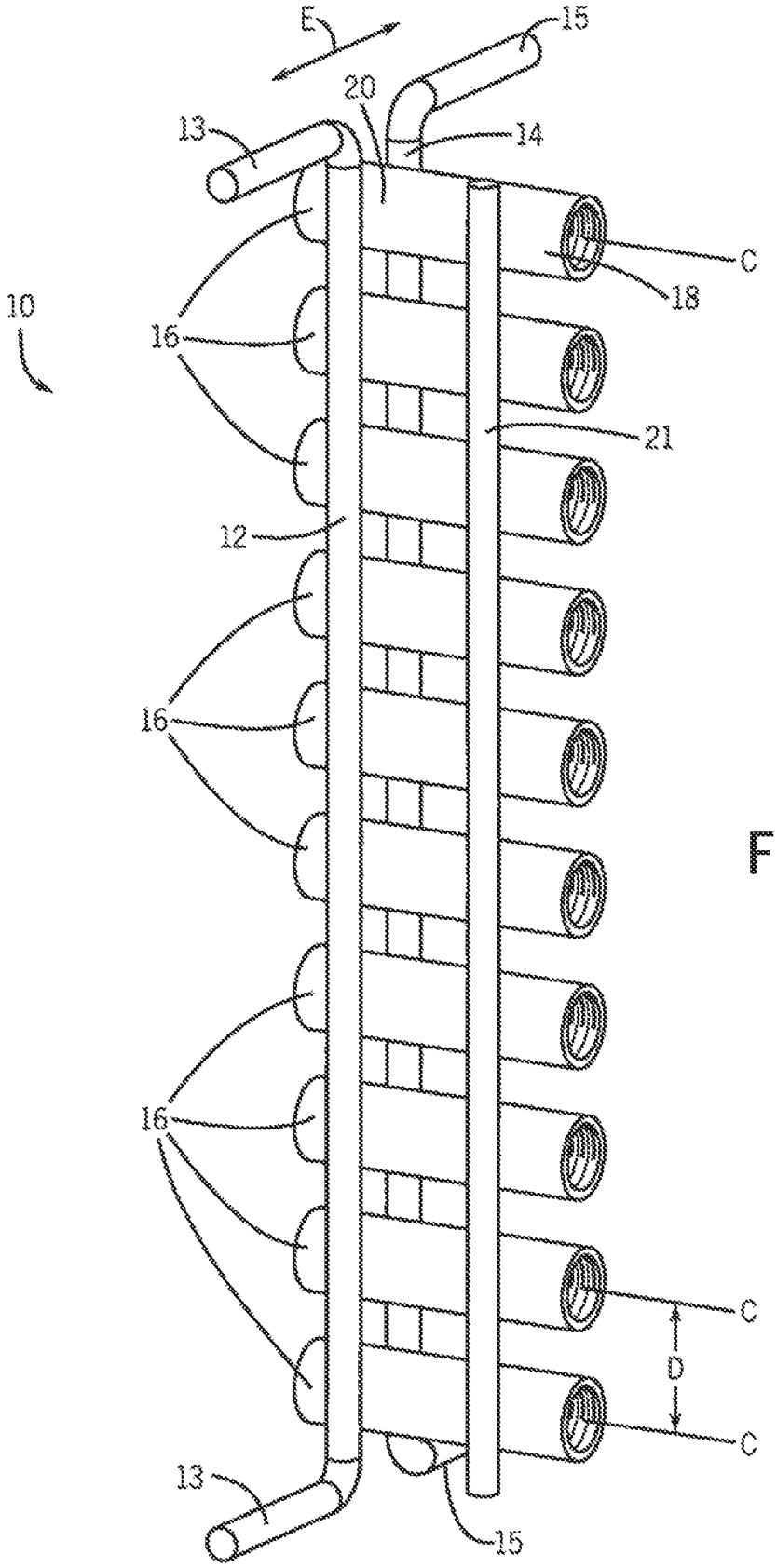
FIG. 1 is a perspective view of a barrier cable anchor rail assembly incorporating the invention.
Figure 2:
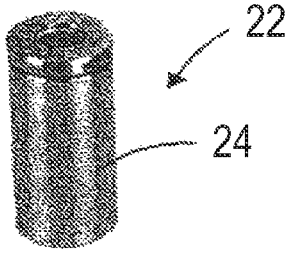
FIG. 2 is a perspective view of a chuck.

Referring to FIG. 1, a barrier cable anchor rail assembly 10 is shown. The barrier cable anchor rail assembly 10 includes a first rail member 12 and a second rail member 14. The rail members 12, 14 are formed from #5 steel rebar, however, it is contemplated that one or more of the rail members 12, 14 can be formed from other sizes and grades of steel rebar or other materials that bond to concrete, and thus serve to reinforce the concrete. The rail members 12, 14 are not made of materials that do not bond to concrete, such as plastic.

Threaded connectors 16 also form part of the barrier cable anchor rail assembly 10. The threaded connectors 16 shown in FIG. 1 are ferrule stems. Each threaded connector has a central axis C, a proximal end 18, and a distal end 20, with these features only being labeled on the uppermost threaded connector 16 illustrated in FIG. 1 for purposes of clarity. Although ten threaded connectors 16 are shown as forming part of the barrier cable anchor rail assembly 10, the amount of threaded connectors 16 can be varied depending on the amount of cables necessary or desired for the barrier for which the barrier cable anchor rail assembly 10 may be used. The threaded connectors 16 illustrated in FIG. 1 are internally threaded, however, the threaded connectors 16 can alternatively and/or additionally be externally threaded.

As illustrated in FIG. 1, the threaded connectors 16 are attached to the first rail member 12 and the second rail member 14 in the same orientation and such that there is a predetermined spacing D between the central axis C of each successive threaded connector 16 (the predetermined spacing D is only illustrated for the lowest two threaded connectors 16 in FIG. 1 for purposes of clarity). The predetermined spacing D can be set to different dimensions, according to specific standards or best practices. For example, the predetermined spacing D can be about four inches. The connectors 16 are attached to the rail members 14, 16 by a weld, however, other methods of attachments including, but not limited to, fasteners and adhesives are also contemplated. The connectors 16 can extend perpendicularly to the rail members, or if the assembly is used on an angled surface, such as in a parking garage, the connector 16 can be angled relative to the rails, so as to have the barrier cables run parallel to the road surface, even though the columns extend vertically to the horizon.

In the barrier cable anchor rail assembly 10, the second rail member 14 is shown as being opposite from the first rail member 12 in a direction E transverse to the central axis C of the threaded connectors 16. As illustrated in FIG. 1, the first rail member 12 includes end portions 13 that extend away from the second rail member 14 in a direction E transverse to the central axis C of the threaded connectors 16. Likewise, the second rail member 14 includes end portions 15 that extend away from the first rail member 12 in a direction E transverse to the central axis C of the threaded connectors 16. The end portions 13, 15 of the rail members 12, 14 assist in balancing the barrier cable anchor rail assembly 10 during installation into concrete and additionally provide support to the concrete structure in which the barrier cable anchor assembly is encapsulated, as will be described in further detail below.

The barrier cable anchor rail assembly 10 as illustrated in FIG. 1 also includes a support bar 21. The support bar 21 is formed from steel rebar, such as #4 rebar. Similar to the first and second rail members 12, 14, it is contemplated that the support bar 21 can be formed from other sizes and grades of steel rebar or other materials. The support bar 21 is attached to each of the threaded connectors 16 at their proximal end 18 to provide support to the assembly 10 and to maintain the orientation of the threaded connectors as well as their predetermined spacing D. The support bar 21 in FIG. 1 is attached to the threaded connectors 16 by a weld, but other methods of attachment are contemplated. The support bar 21 also provides structural support to the structure in which the barrier cable anchor rail assembly 10 is encapsulated.

Figure 3:
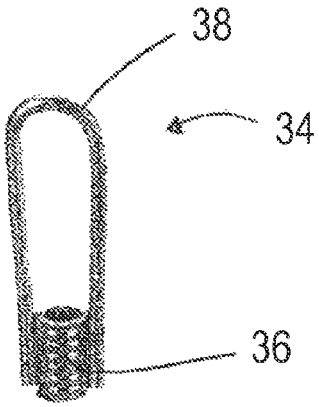
FIG. 3 is a perspective view of a ferrule loop.
Figure 4:
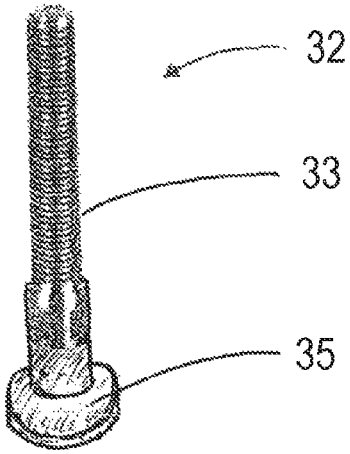
FIG. 4 is a perspective view of a threaded stem or nelson stud.

Although the threaded connectors 16 in the embodiment shown in FIG. 1 are ferrule stems, the barrier cable anchor rail assembly 10 can additionally or alternatively include threaded connectors 16 that are ferrule loops 34 (shown in FIG. 3), threaded stems 32, also known as nelson studs (shown in FIG. 4), and the like. The ferrule loops 34 shown in FIG. 3 include a body 36 that is internally threaded and a loop 38. The nelson stud 32 shown in FIG. 4 includes external threads 33 and a head 35. The ferrule loops 34 and the nelson stud 32 can be attached directly to the first rail member 12, second rail member 14, and support bar 21 in the same manner as described above with respect to the ferrule stem. In any event, the threaded connector 16 of the barrier cable anchor rail assembly 10 is capable of being engaged by a chuck 22.

Figure 5:
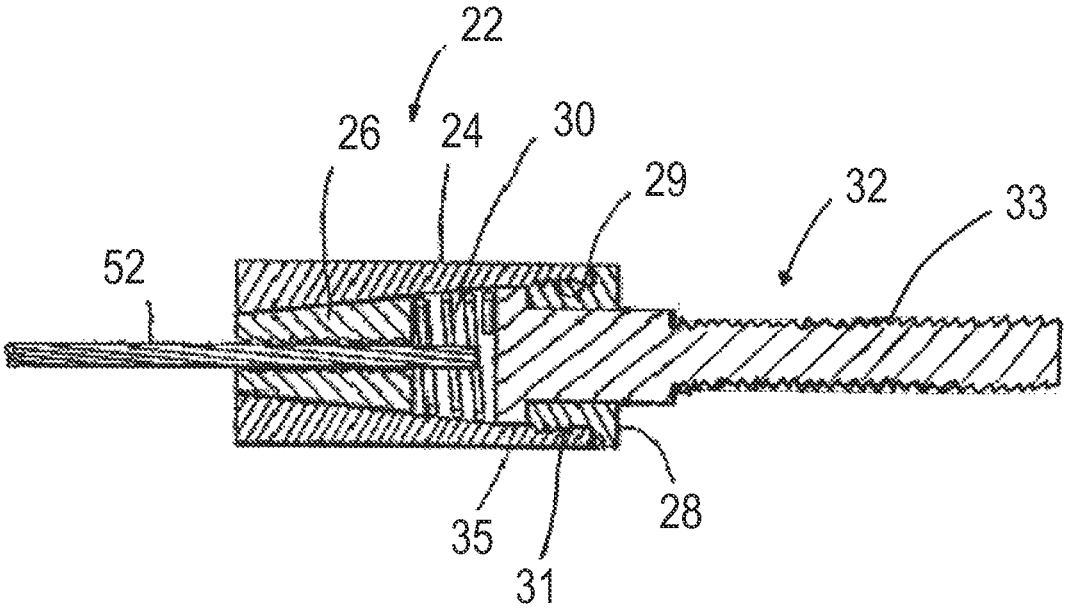
FIG. 5 is a cross-sectional view of a nelson stud assembled with a chuck and the chuck gripping a cable.

The threaded connectors 16 are each adapted to be engaged by a chuck 22 that is configured to engage a cable. As shown in FIG. 5, a chuck 22 is shown that is configured to engage a cable 52 and a nelson stud 32. The chuck 22 includes a body 24 and cable grippers 26 that are adapted to engage and secure a cable 52 in the body 24 of the chuck 22. The chuck 22 further includes a cap 28 that includes threads 29 that match the threads 31 of the body 24 of the chuck 22. The chuck 22 can also include a compression spring 30. As is known in the art, the cap 28 captures the nelson stud 32 and is threaded to the chuck 22 such that the nelson stud 32 is coupled to the chuck 22. Thus, the threaded connectors 16 of the barrier cable anchor rail assembly 10 of FIG. 1 are each adapted to be engaged by a chuck 22 by receiving a threaded stem 32, which in turn is captured by, or coupled to, the chuck 22.

Figure 6:
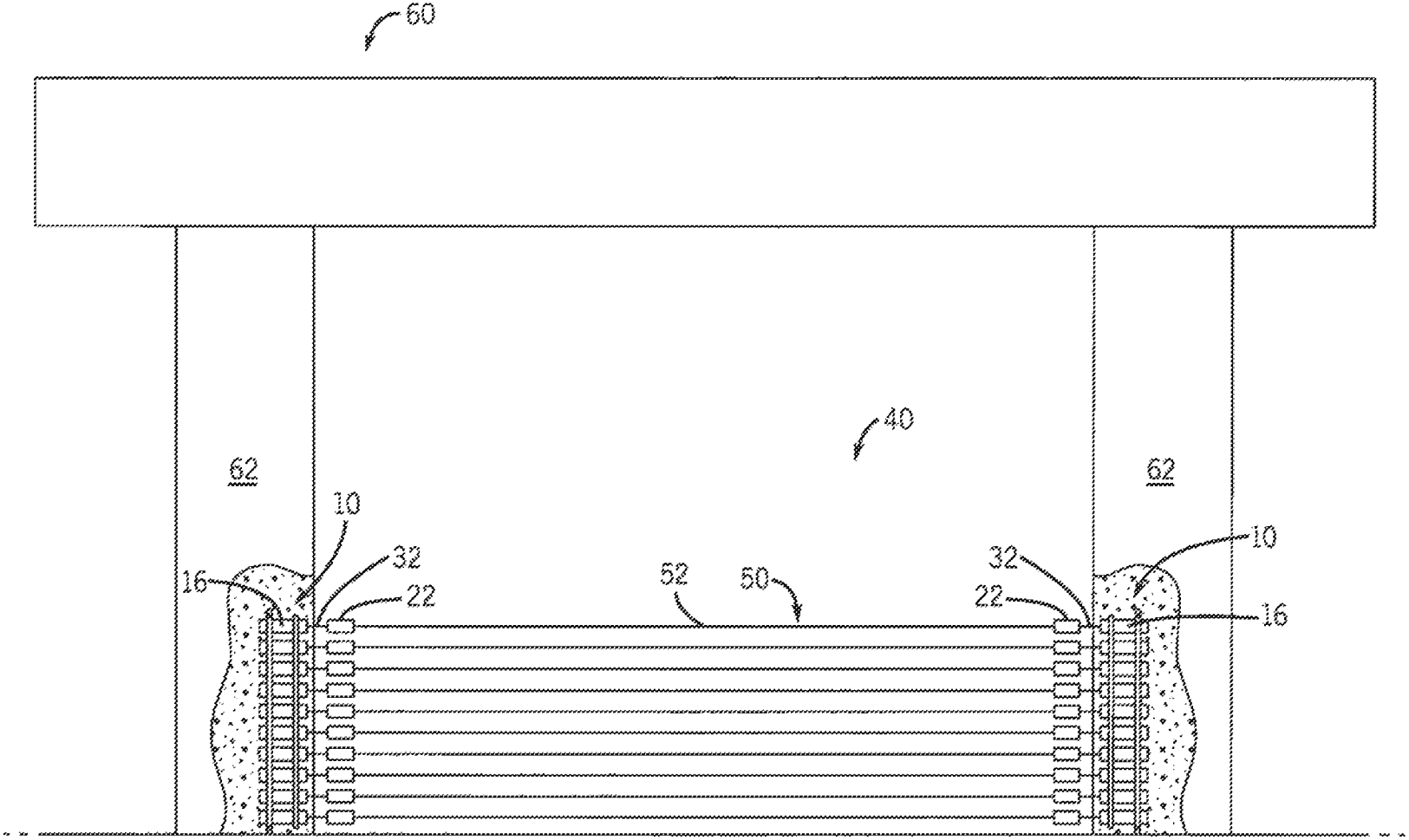
FIG. 6 is a side elevation view of a barrier formed between two successive columns of concrete.

Referring now to FIG. 6, a cable barrier assembly 40 that is adapted to form a cable barrier 50 between concrete columns 62 of a concrete structure 60 is shown. While FIG.

6 illustrates a cable barrier assembly 40 between successive concrete columns 62, it is also contemplated that the cable barrier assembly 40 may form a barrier across more than two concrete columns, such as in the situation where there are two terminal concrete columns with one or more intermediate concrete columns (not shown) located in between the two terminal concrete columns. To form the cable barrier 50, a barrier cable anchor rail assembly 10 as described above is encapsulated in each concrete column 62. Although FIG. 6 shows a barrier cable anchor rail assembly 10 in both concrete columns 62, it is contemplated that a cable barrier assembly 40 can be constructed with the use of a barrier cable anchor rail assembly 10 in only one of the concrete columns 62. The barrier 50 as shown in FIG. 6 is formed from ten cables 52 (only the uppermost cable 52 is labeled in FIG. 5 for purposes of clarity), however it is contemplated that cable barriers 50 could be formed of more or less cables 52 based on factors such as the desired spacing between each cable and/or the total height of the cable barrier 50. Each cable 52 spans between chucks 22 that engage a threaded connector 16 through their connection with a threaded stem 32 in each of the barrier cable anchor rail assemblies 10. In the situation where there are intermediate concrete columns, the cables 52 may extend through transverse openings in the intermediate concrete columns.

As illustrated in FIG. 6, the barrier cable anchor rail assemblies 10 are encapsulated in the concrete columns 62. Advantageously, the fabrication of the barrier cable anchor rail assembly 10 provides a plurality of threaded connectors 16 in the same orientation and with a predetermined spacing D by attaching the threaded connectors 16 to the first and second rail members 12, as described above with respect to FIG. 1. This design allows the threaded connectors 16 to be efficiently and accurately cast in the column of concrete 62 by mere placement of the barrier cable anchor rail assembly 10, rather than individually measuring for the placement of each threaded connector 16. Thus, the cable barrier 50 can be constructed more efficiently and more accurately. Furthermore, because the threaded connectors 16 are attached to a rigid structure, the curing of the concrete will not compromise their orientation nor their predetermined spacing D.

The encapsulated nature of the barrier cable anchor rail assembly 10 can also provide additional advantages. For example, because the barrier cable anchor rail assembly 10 is encapsulated in a concrete column 62 of the structure 60, the first rail member 12, the second rail member 14, and the support bar 21 can provide structural support to the concrete structure 60. Additionally, the encapsulated nature of the barrier cable anchor rail assembly 10 also provides protection for the assembly 10 against corrosion. Because the assembly 10 is cast directly into the concrete structure 60, no drilling must be done as in previous methods that may lead to unintended chips or cracks in the concrete structure 60.

Even though the barrier cable anchor rail assembly 10 is encapsulated in the concrete structure 60, the threads of the threaded connector 16 are exposed to the outside of the concrete structure 60. This allows for the threaded connector 16 to engage a threaded stem 32 and the threaded stem 32 to be coupled to the chuck 22, thus allowing the threaded connector 16 to be engaged by the chuck 22. As shown in FIG. 6, the chucks 22 are outside of the concrete structure 60. This provides easy access for maintenance or repair to a damaged cable 52.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention.

Use of ordinal terms such as "first", "second", "third", etc., in the claims to modify a claim element does not by itself connote any priority, precedence, or order of one claim element over another, but are used merely as labels to distinguish one claim element having a certain name from another element having a same name (but for use of the ordinal term) to distinguish the claim elements.

Thus, the invention is to cover all modifications, equivalents, and alternatives falling within the spirit and scope of the invention as defined by the following appended claims. To apprise the public of the scope of this invention, the following claims are made.

I claim:

1. A barrier cable assembly adapted to form a barrier between a first concrete column and a second concrete column spaced apart from the first concrete column, the cable barrier assembly comprising:

a plurality of cables, each of the plurality of cables including a first end and a second end;

a first cable anchor rail assembly comprising:

a first elongated member;

a first plurality of connectors coupled to the first elongated member such that a predetermined spacing exists between each adjacent connector; and wherein the first cable anchor rail assembly is at least partially cast in the first concrete column, at least a portion of each of the first plurality of connectors positioned outside of the first concrete column, and the first end of each of the plurality of cables engaging one of the first plurality of connectors of the first cable anchor rail assembly in the first concrete column; and a second cable anchor rail assembly comprising:

a second elongated member;

a second plurality of connectors coupled to the second elongated member such that a predetermined spacing exists between each adjacent connector; and wherein the second cable anchor rail assembly is at least partially cast in the second concrete column, at least a portion of each of the second plurality of connectors positioned outside of the second concrete column, and the second end of each of the plurality of cables engaging one of the second plurality of connectors of the second cable anchor rail assembly in the second concrete column.

2. The barrier cable assembly of claim 1, wherein at least one intermediate concrete column is positioned between the first concrete column and the second concrete column, the plurality of cables extending through the at least one intermediate concrete column.

3. The barrier cable assembly of claim 1, wherein each of the first plurality of connectors and each of the second plurality of connectors is a threaded connector.

4. The barrier cable assembly of claim 3, wherein each of the first plurality of connectors and each of the second plurality of connectors is one of an internally threaded ferrule stem, an internally threaded ferrule loop, and an externally threaded nelson stud.

5. The barrier cable assembly of claim 3, further comprising a plurality of chucks engaged with the plurality of connectors, each chuck including a cable gripper engaged with one of the plurality of cables.

6. The barrier cable assembly of claim 1, wherein the first elongated member and the second elongated member are formed from steel rebar.

7. The barrier cable assembly of claim 1, wherein the first cable anchor rail assembly further comprise a first support bar, the first support bar being coupled to each of the first plurality of connectors at a proximal end of each of the plurality of connectors and the first rail member is coupled to each of the first plurality of connectors at a distal end of each of the plurality of connectors; and wherein the second cable anchor rail assembly further comprise a second support bar, the second support bar being coupled to each of the second plurality of connectors at a proximal end of each of the second plurality of connectors and the second elongated member is coupled to each of the second plurality of connectors at a distal end of each of the plurality of connectors.

8. The barrier cable assembly of claim 7, wherein the first support bar is cast in the first concrete column and the second support bar is cast in the second concrete column.

9. A barrier cable anchor rail assembly cast in a column of concrete and adapted to engage a plurality of cables to provide a barrier between the column of concrete and a successive column of concrete in a structure, the assembly comprising:

an elongated first rail member defining a rail length;

an elongated second rail member parallel to the first rail member;

a plurality of connectors being adapted to each engage an end of one of the plurality of cables, each of the plurality of connectors being coupled to the first rail member along the rail length and coupled to the second rail member, each of the plurality of connectors positioned in the same orientation, each of the plurality of connectors is spaced apart from an adjacent one of the plurality of connectors by a predetermined distance, a portion of each of the plurality of connectors positioned outside of the column of concrete in which the barrier cable anchor rail assembly is cast; and a support bar for supporting the plurality of connectors.

10. The barrier cable anchor rail assembly of claim 9, wherein each of the plurality of connectors have a proximal end and a distal end, the first rail member and second rail member engage the distal end of each of the plurality of connectors, and the support bar engages the proximal end of each of the plurality of connectors.

11. The barrier cable anchor rail assembly of claim 9, wherein each of the plurality of connectors is a threaded connector.

12. The barrier cable anchor rail assembly of claim 11, wherein each of the plurality of connectors are one of an internally threaded ferrule stem, an internally threaded ferrule loop, and an externally threaded nelson stud.

13. The barrier cable anchor rail assembly of claim 9, further comprising a plurality of chucks engaged with the plurality of connectors, each chuck including a cable gripper engaged with one of the plurality of cables.

14. A barrier cable anchor rail assembly adapted to be cast in a concrete column and engage a plurality of cables to provide a barrier between the column and another column of concrete in a structure, the assembly comprising:

a first rail member; and a plurality of connectors coupled to the first rail member, each of the plurality of connectors adapted to engage an end of one of the plurality of cables, each of the plurality of connectors is positioned and dimensioned to be partially exposed to the outside of the column of concrete in which the barrier cable anchor rail assembly is cast, wherein each of the plurality of connectors defines a central axis, the central axis being perpendicular to the length of the first rail member.

15. The barrier cable anchor rail assembly of claim 14, further comprising a second rail member, wherein the second rail member is spaced apart from the first rail member and is aligned with the first rail member in a direction transverse to the central axis of each of the plurality of connectors, the plurality of connectors being attached to the second rail member.

16. The barrier cable anchor rail assembly of claim 15, wherein the first rail member and the second rail member are formed from steel rebar.

17. The barrier cable anchor rail assembly of claim 14, wherein each of the plurality of connectors is a threaded connector.

18. The barrier cable anchor rail assembly of claim 17, wherein each of the plurality of connectors is one of an internally threaded ferrule stem, an internally threaded ferrule loop, and an externally threaded nelson stud.

19. The barrier cable anchor rail assembly of claim 17, further comprising a plurality of chucks engaged with the plurality of connectors, each chuck including a cable gripper engaged with one of the plurality of cables.

20. A barrier cable anchor rail assembly adapted to be cast in a concrete column and engage a plurality of cables to provide a barrier between the column and another column of concrete in a structure, the assembly comprising:

a first rail member; and a plurality of connectors coupled to the first rail member, each of the plurality of connectors adapted to engage an end of one of the plurality of cables, each of the plurality of connectors is positioned and dimensioned to be partially exposed to the outside of the column of concrete in which the barrier cable anchor rail assembly is cast, wherein each of the plurality of connectors includes a proximal end and a distal end, and further comprising a support bar attached to the proximal end of each of the plurality of connectors, wherein the first rail member is attached to the distal end of each of the plurality of connectors.

21. The barrier cable anchor rail assembly of claim 20, wherein the support bar is formed from steel rebar.

* * * * *